US010590713B1

(12) United States Patent
Puppel

(10) Patent No.: US 10,590,713 B1
(45) Date of Patent: Mar. 17, 2020

(54) SOIL BORING DEVICE AND A KIT INCLUDING THE SAME

(71) Applicant: Richard Allen Puppel, Columbus, OH (US)

(72) Inventor: Richard Allen Puppel, Columbus, OH (US)

( * ) Notice: Subject to any disclaimer, the term of this patent is extended or adjusted under 35 U.S.C. 154(b) by 0 days.

(21) Appl. No.: 16/103,165

(22) Filed: Aug. 14, 2018

Related U.S. Application Data

(60) Provisional application No. 62/677,118, filed on May 28, 2018.

(51) Int. Cl.

| | |
|---|---|
| ***E21B 11/00*** | (2006.01) |
| ***E21B 10/60*** | (2006.01) |
| ***E21B 3/025*** | (2006.01) |
| *E02F 3/92* | (2006.01) |
| *E21B 7/18* | (2006.01) |

(52) U.S. Cl.
CPC ..... *E21B 11/005* (2013.01); *E21B 3/025* (2013.01); *E21B 10/60* (2013.01); *E02F 3/9262* (2013.01); *E21B 7/18* (2013.01)

(58) Field of Classification Search
CPC ..... E21B 11/005; E21B 7/18
See application file for complete search history.

(56) References Cited

U.S. PATENT DOCUMENTS 354,265 A * 12/1886 Stephen ..... E21B 11/005 175/384
2,169,718 A 8/1939 Boll et al.
3,061,022 A * 10/1962 Wells ..... E21B 7/18 175/54
3,422,913 A 1/1969 Young, Jr.
3,638,741 A 2/1972 Zizak
(Continued)

FOREIGN PATENT DOCUMENTS

EP 0496481 A2 7/1992
EP 0548588 A1 6/1993

OTHER PUBLICATIONS

Pond Construction Page, Clarke Koi Ponds, Inc. Website, Web page <http://www.clarkekoi.com/pond-bottom-drains.html>, 3 pages, dated Dec. 19, 2012, retrieved from www.clarkekoi.com website on Aug. 6, 2019.

(Continued)

*Primary Examiner* — Giovanna C Wright
(74) *Attorney, Agent, or Firm* — The Law Office of Patrick F. O'Reilly, III, LLC

(57) ABSTRACT

A soil boring device and a kit including the same are disclosed herein. The soil boring device includes an elongate tubular body portion; at least one fin member configured to loosen soil when the soil boring device is rotated by a user; at least one handle portion extending outwardly from the elongate tubular body portion; and a water connection subassembly coupled to the elongate tubular body portion. The soil boring device is configured to discharge water from the water outlet of the elongate tubular body portion so as to moisten soil adjacent to the soil boring device, thereby facilitating the forming of the hole in the ground by allowing the soil to be more easily loosened by the at least one fin member. The soil boring device may be provided in conjunction with a soil boring kit that may further include a vacuum collar and a vacuum wand.

21 Claims, 14 Drawing Sheets

(56) References Cited

U.S. PATENT DOCUMENTS

| | | | |
|---|---|---|---|
| 3,825,082 | A | 7/1974 | Woodruff |
| 3,830,310 | A | 8/1974 | Williams |
| 5,212,891 | A | 5/1993 | Schuermann et al. |
| 6,196,337 | B1 | 3/2001 | Sikes |
| 6,564,880 | B2 | 5/2003 | Williams et al. |
| 7,185,720 | B1 | 3/2007 | Menna |
| 8,230,950 | B2 | 7/2012 | Alcov |
| 2003/0196375 | A1 | 10/2003 | Ferro |
| 2016/0145944 | A1 | 5/2016 | Reed |

OTHER PUBLICATIONS

"How to Dig & Run Pipe Under a Driveway or Sidewalk", Sprinkler Warehouse Website, Web page <https://www.sprinklerwarehouse.com/school/design-install/how-to-dig-run-pipe-under-a-driveway-or-sidewalk/>, 4 pages, dated Nov. 27, 2017, retrieved from www.sprinklerwarehouse.com website on Aug. 6, 2019.

"Grout Pool Bottom and Vinyl Liner Install", Swimming Pool Build Website, Web page <http://swimmingpoolbuild.com/home/grout-pool-bottom-and-vinyl-liner-install/>, 14 pages, dated at least as early as Feb. 25, 2018, retrieved from swimmingpoolbuild.com website on Aug. 6, 2019.

"Post Hole Digger Introduction" YouTube Video, YouTube Website, Web page <https://www.youtube.com/watch?v=-vcEOfNFfGg>, 2 pages, published on Jan. 13, 2016, retrieved from YouTube.com on Aug. 6, 2019.

"Drinking Water—digging a well?", Permies Website, Web page <https://permies.com/t/25013/permaculture-projects/Drinking-Water-digging>, 75 pages, dated at least as early as Aug. 2013, retrieved from www.permies.com website on Aug. 6, 2019.

* cited by examiner

Section A - A

SOIL BORING DEVICE AND A KIT INCLUDING THE SAME

CROSS-REFERENCE TO RELATED APPLICATIONS

This patent application claims priority to, and incorporates by reference in its entirety, U.S. Provisional Patent Application No. 62/677,118, entitled "Soil Boring Device And A Kit Including The Same", filed on May 28, 2018.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a soil boring device and a kit including the same. More particularly, the invention relates to a soil boring device for forming a hole in the ground and a kit that includes soil boring device with one or more additional devices for facilitating the forming of the hole in the ground.

2. Background

There are multiple reasons to bore holes in the ground. For example, in the care of plants (e.g., trees and shrubs), especially in the urban environment, there can arise the need to bore holes in the soil surrounding plants for many different purposes, such as (i) aeration, (ii) "vertical mulching" (i.e., a columnar soil amendment using a variety of materials), (iii) decompaction of soil (i.e., to alleviate soil compaction), (iv) improved drainage, and/or (v) deep fertilization. In some instances, these holes in the ground can have a diameter of approximately two (2) inches to three (3) inches, and may have a depth between approximately eight (8) inches to forty-eight (48) inches.

However, conventional tools for boring holes in the ground have numerous limitations and drawbacks. For example, many of these conventional tools are very difficult to use, thus making the forming of holes in the ground both laborious and time-consuming. Moreover, some of these conventional tools contain sharp blades that can cause serious damage to tree roots and underground utility lines. Furthermore, many of these conventional tools create a messy environment (e.g., by creating areas of wet or dry, excavated dirt in a lawn) that requires substantial clean-up by the user of the tool after the hole has been formed.

Therefore, what is needed is a soil boring device that is easy to use, thus facilitating and expediting the forming of holes in the ground. Moreover, a soil boring device is needed that does not contain sharp cutting edges so as to minimize the likelihood that any tree roots and underground utility lines will be damaged. Furthermore, there is a need for a soil boring kit that collects a majority of the excavated material so as to minimize any subsequent clean-up that is required by the user.

BRIEF SUMMARY OF EMBODIMENTS OF THE INVENTION

Accordingly, the present invention is directed to a soil boring device and a kit including the same that substantially obviates one or more problems resulting from the limitations and deficiencies of the related art.

In accordance with one or more embodiments of the present invention, there is provided a soil boring device for forming a hole in the ground. The soil boring device includes an elongate tubular body portion having a first end and a second end disposed opposite to the first end, the elongate tubular body portion defining a fluid passageway disposed therein, the elongate tubular body portion further defining a water outlet fluidly coupled to the fluid passageway for discharging water from the soil boring device; at least one fin member protruding from an outer surface of the elongate tubular body portion, the at least one fin member configured to loosen soil when the soil boring device is rotated about a centrally disposed longitudinal axis of the elongate tubular body portion by a user; at least one handle portion extending outwardly from the elongate tubular body portion, the at least one handle portion configured to be grasped by the user while the user is rotating the soil boring device about the centrally disposed longitudinal axis; and a water connection subassembly coupled to the elongate tubular body portion, the water connection subassembly defining a water inlet for supplying water to the fluid passageway of the elongate tubular body portion. The soil boring device is configured to discharge water from the water outlet of the elongate tubular body portion so as to moisten soil adjacent to the soil boring device, thereby facilitating the forming of the hole in the ground by allowing the soil to be more easily loosened by the at least one fin member.

In a further embodiment of the present invention, the fluid passageway extends from the first end of the elongate tubular body portion to the water outlet at the second end of the elongate tubular body portion; and wherein the elongate tubular body portion further comprises an imperforate peripheral sidewall defining the fluid passageway.

In yet a further embodiment, the at least one fin member comprises a plurality of fin members, the plurality of fin members being circumferentially spaced apart about a periphery of the outer surface of the elongate tubular body portion.

In still a further embodiment, the at least one fin member comprises tapered end portions and rounded edges, the rounded edges of the at least one fin member configured to prevent the at least one fin member from cutting tree roots and damaging underground utility lines.

In yet a further embodiment, the at least one handle portion comprises a first handle portion and a second handle portion, the first and second handle portions extending outwardly from the elongate tubular body portion in respective opposite directions, and the first and second handle portions being disposed proximate to the first end of the elongate tubular body portion.

In still a further embodiment, the water connection subassembly comprises a water valve configured to regulate the flow of water into the fluid passageway of the elongate tubular body portion, and the water connection subassembly further comprising a hose connector disposed upstream of the water valve, the hose connector defining the water inlet of the soil boring device.

In yet a further embodiment, the water connection subassembly further comprises a U-shaped connection between the water valve and the first end of the elongate tubular body portion.

In still a further embodiment, a central axis of the hose connector is disposed generally parallel to, and closely spaced apart from, the centrally disposed longitudinal axis of the elongate tubular body portion so as to minimize the inertial forces resulting from the weight of a water hose connected to the soil boring device.

In accordance with one or more other embodiments of the present invention, there is provided a soil boring kit that includes a soil boring device for forming a hole in the ground and a vacuum collar configured to collect and extract water and loosened soil from a top of the hole in the ground. The soil boring device includes an elongate tubular body portion having a first end and a second end disposed opposite to the first end, the elongate tubular body portion defining a fluid passageway disposed therein, the elongate tubular body portion further defining a water outlet fluidly coupled to the fluid passageway for discharging water from the soil boring device; at least one fin member protruding from an outer surface of the elongate tubular body portion, the at least one fin member configured to loosen soil when the soil boring device is rotated about a centrally disposed longitudinal axis of the elongate tubular body portion by a user; at least one handle portion extending outwardly from the elongate tubular body portion, the at least one handle portion configured to be grasped by the user while the user is rotating the soil boring device about the centrally disposed longitudinal axis; and a water connection subassembly coupled to the elongate tubular body portion, the water connection subassembly defining a water inlet for supplying water to the fluid passageway of the elongate tubular body portion. The soil boring device is configured to discharge water from the water outlet of the elongate tubular body portion so as to moisten soil adjacent to the soil boring device, thereby facilitating the forming of the hole in the ground by allowing the soil to be more easily loosened by the at least one fin member. The vacuum collar includes a hollow body portion, the hollow body portion defining an internal cavity configured to receive the water and loosened soil at the top of the hole, the hollow body portion defining an aperture in an end wall thereof, the aperture configured to receive a portion of the elongate tubular body portion of the soil boring device passing therethrough; and a vacuum hose connection member extending outwardly from the hollow body portion, the vacuum hose connection member configured to fluidly couple the vacuum collar to a vacuum source so as to enable the water and loosened soil in the internal cavity of the hollow body portion to be extracted from the vacuum collar.

In a further embodiment of the present invention, the fluid passageway of the soil boring device extends from the first end of the elongate tubular body portion to the water outlet at the second end of the elongate tubular body portion; and wherein the elongate tubular body portion further comprises an imperforate peripheral sidewall defining the fluid passageway.

In yet a further embodiment, the at least one fin member of the soil boring device comprises a plurality of fin members, the plurality of fin members being circumferentially spaced apart about a periphery of the outer surface of the elongate tubular body portion.

In still a further embodiment, the at least one fin member of the soil boring device comprises tapered end portions and rounded edges, the rounded edges of the at least one fin member configured to prevent the at least one fin member from cutting tree roots and damaging underground utility lines.

In yet a further embodiment, the at least one handle portion of the soil boring device comprises a first handle portion and a second handle portion, the first and second handle portions extending outwardly from the elongate tubular body portion in respective opposite directions, and the first and second handle portions being disposed proximate to the first end of the elongate tubular body portion.

In still a further embodiment, the water connection subassembly of the soil boring device comprises a water valve configured to regulate the flow of water into the fluid passageway of the elongate tubular body portion, and the water connection subassembly further comprises a hose connector disposed upstream of the water valve, the hose connector defining the water inlet of the soil boring device.

In yet a further embodiment, the water connection subassembly of the soil boring device further comprises a U-shaped connection between the water valve and the first end of the elongate tubular body portion.

In still a further embodiment, a central axis of the hose connector is disposed generally parallel to, and closely spaced apart from, the centrally disposed longitudinal axis of the elongate tubular body portion so as to minimize the inertial forces resulting from the weight of a water hose connected to the soil boring device.

In yet a further embodiment, the end wall of the hollow body portion of the vacuum collar that contains the aperture is disposed at a top of the hollow body portion; and the hollow body portion of the vacuum collar further comprises an open bottom disposed opposite to the top end wall, the open bottom of the vacuum collar configured to be disposed against the ground at the top of the hole in the ground.

In still a further embodiment, the vacuum hose connection member of the vacuum collar has a central axis that is disposed generally perpendicular to a centrally disposed axis of the hollow body portion of the vacuum collar.

In yet a further embodiment, the soil boring kit further comprises a vacuum wand. The vacuum wand includes a wand elongate tubular body portion that is configured to be inserted into the hole in the ground, the wand elongate tubular body portion comprising a vacuum inlet disposed at a first end of the wand elongate tubular body portion and a vacuum outlet disposed at a second end of the wand elongate tubular body portion that is opposite to the first end, the vacuum outlet of the wand elongate tubular body portion configured to be fluidly coupled to the vacuum source so as to create a suction force in the wand elongate tubular body portion, and the vacuum inlet of the wand elongate tubular body portion configured to extract the water and loosened soil from the hole in the ground as a result of the suction force created by the vacuum source.

In still a further embodiment, the vacuum collar and the vacuum wand are configured to be interchangeably connected to the vacuum source.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 14A:
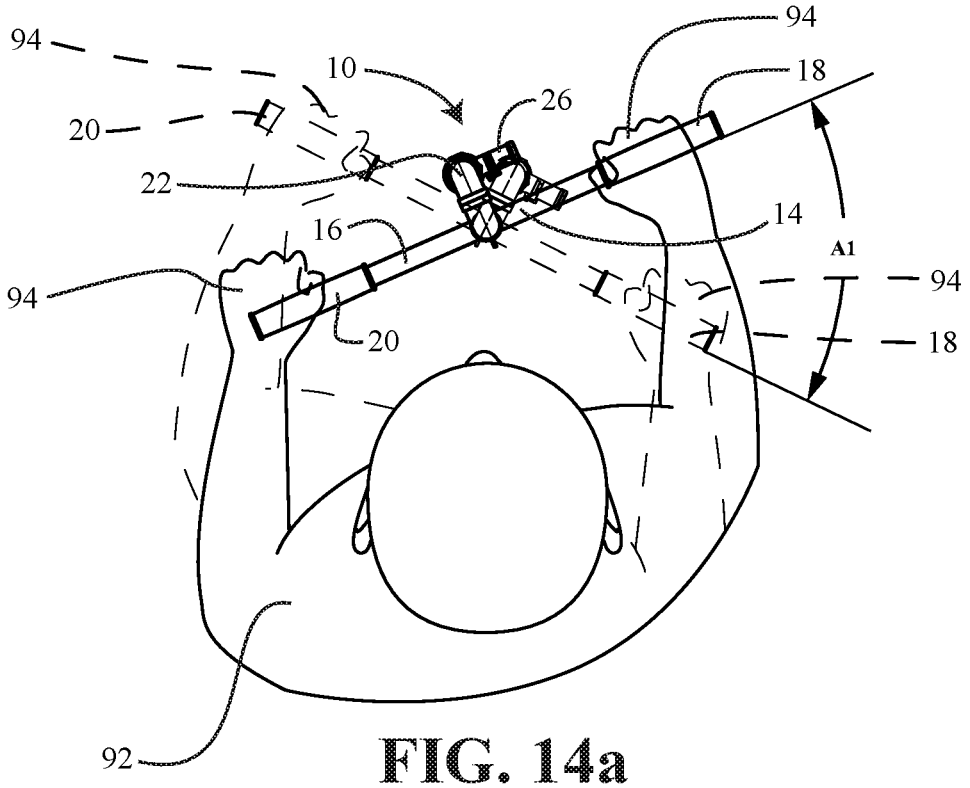
FIG. 14*a* is a top plan view illustrating a user forming a hole in the ground with the soil boring device by rotating the soil boring device in alternating clockwise and counter-clockwise directions.
Figure 14B:
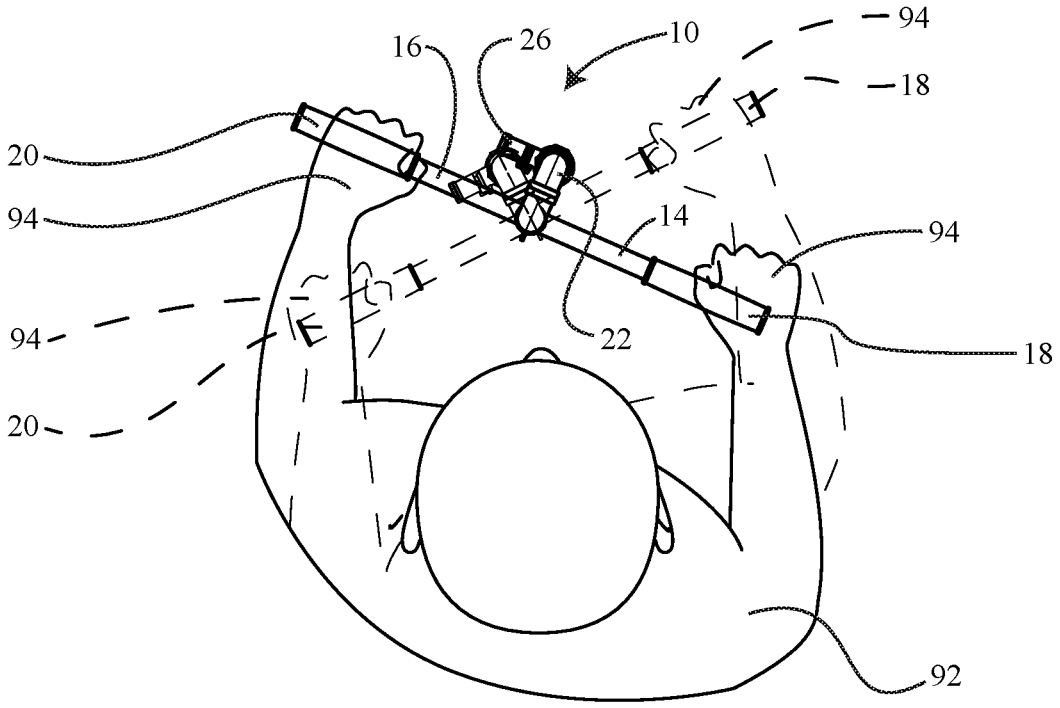
FIG. 14*b* is another top plan view illustrating a user forming a hole in the ground with the soil boring device by rotating the soil boring device in alternating clockwise and counter-clockwise directions.

An illustrative embodiment of a soil boring device 10 for forming a hole in the ground is seen generally at 10 in FIGS. 1-5 and 7. In the illustrative embodiment, referring initially to FIGS. 1-6, the soil boring device 10 generally comprises (i) an elongate tubular body portion 12 having a first upper end 32 and a second lower end 34 disposed opposite to the first end 32 (refer to FIG. 2), the elongate tubular body portion 12 defining a fluid passageway 21 disposed therein (see FIG. 6), the elongate tubular body portion 12 further defining a water outlet 44 fluidly coupled to the fluid passageway 21 for discharging water from the soil boring device 10 (refer to FIG. 5); (ii) a plurality of fin members 36 protruding from an outer surface of the elongate tubular body portion 12, the plurality of fin members 36 configured to loosen soil when the soil boring device 10 is rotated about a centrally disposed longitudinal axis 11 (see FIG. 2) of the elongate tubular body portion 12 by a user; (iii) first and second handle portions 14, 16 extending outwardly from the elongate tubular body portion 12, the first and second handle portions 14, 16 configured to be grasped by the hands 94 of a user 92 while the user is rotating the soil boring device 10 about the centrally disposed longitudinal axis 11 (see FIGS. 14*a* and 14*b*); and (iv) a water connection subassembly 22 coupled to the elongate tubular body portion 12 (refer to FIG. 1), the water connection subassembly 22 defining a water inlet 42 for supplying water to the fluid passageway 21 of the elongate tubular body portion 12. The soil boring device 10 described herein is configured to discharge water from the water outlet 44 of the elongate tubular body portion 12 (see FIG. 15) so as to moisten soil adjacent to the soil boring device 10, thereby facilitating the forming of the hole 96 in the ground by allowing the soil to be more easily loosened by the plurality of fin members 36.

Figure 2:
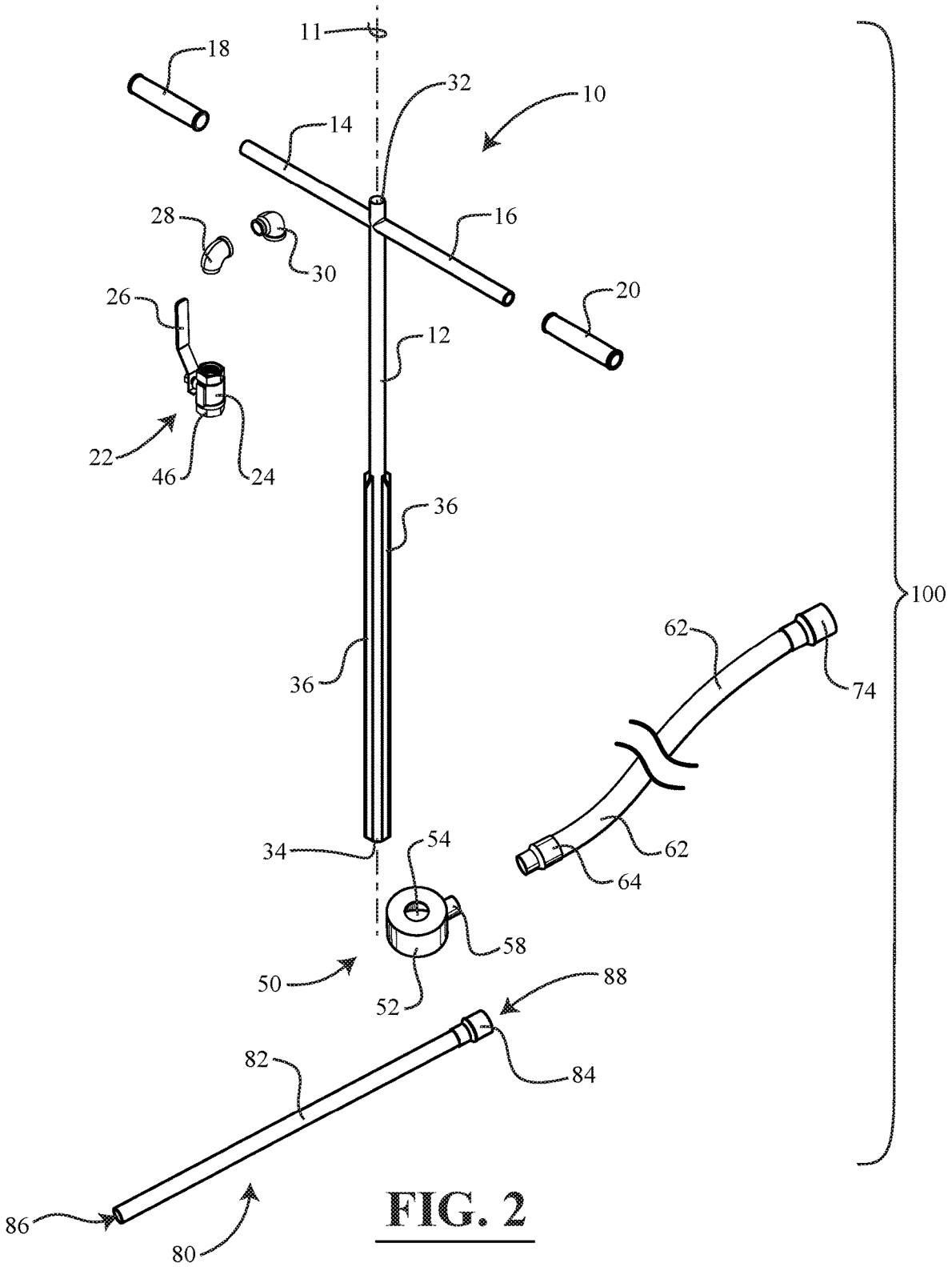
FIG. 2 is an exploded perspective view of the soil boring device and the vacuum collar of FIG. 1 together with a vacuum wand, which form a soil boring kit, according to an illustrative embodiment of the invention.
Figure 3:
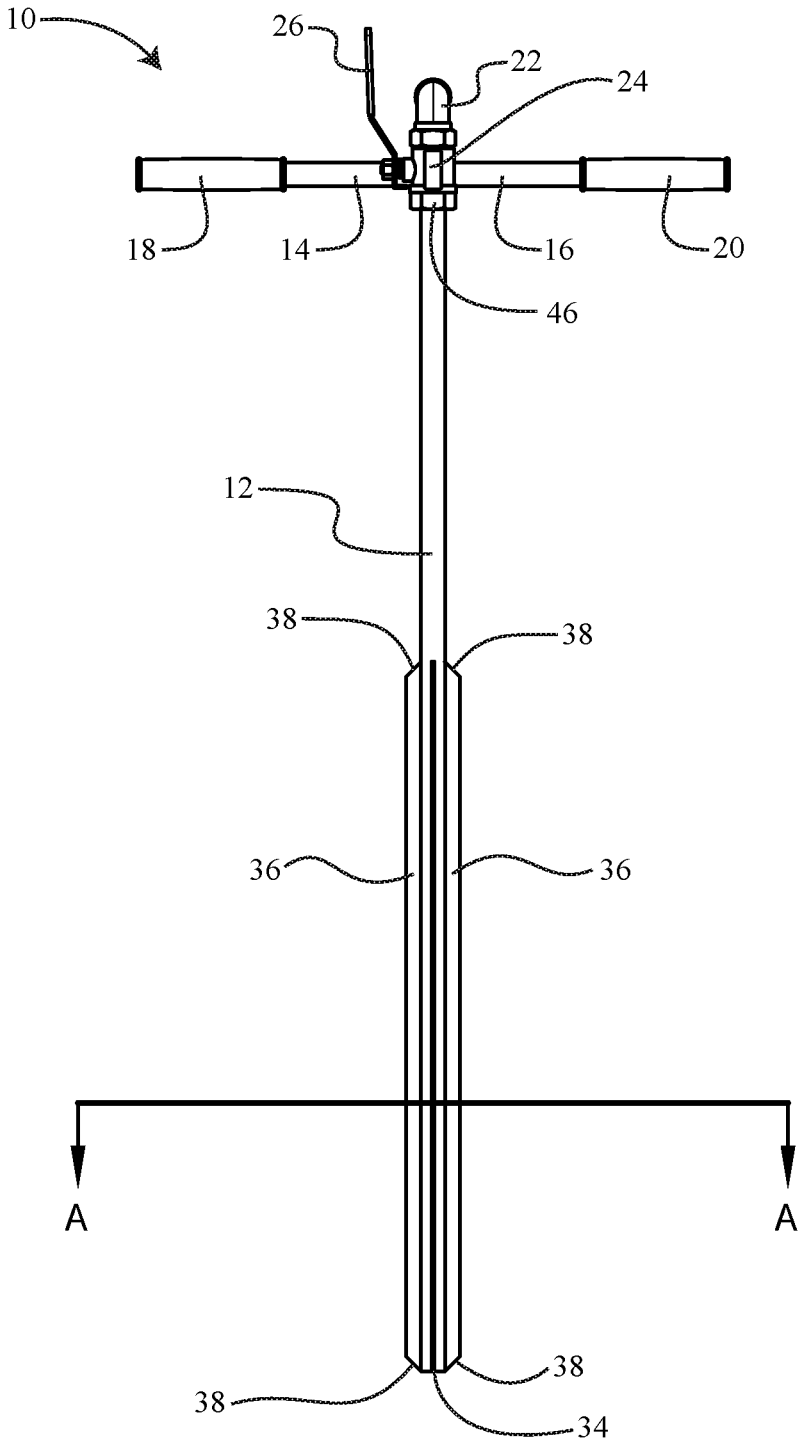
FIG. 3 is a front elevational view of the soil boring device of FIG. 1.
Figure 4:
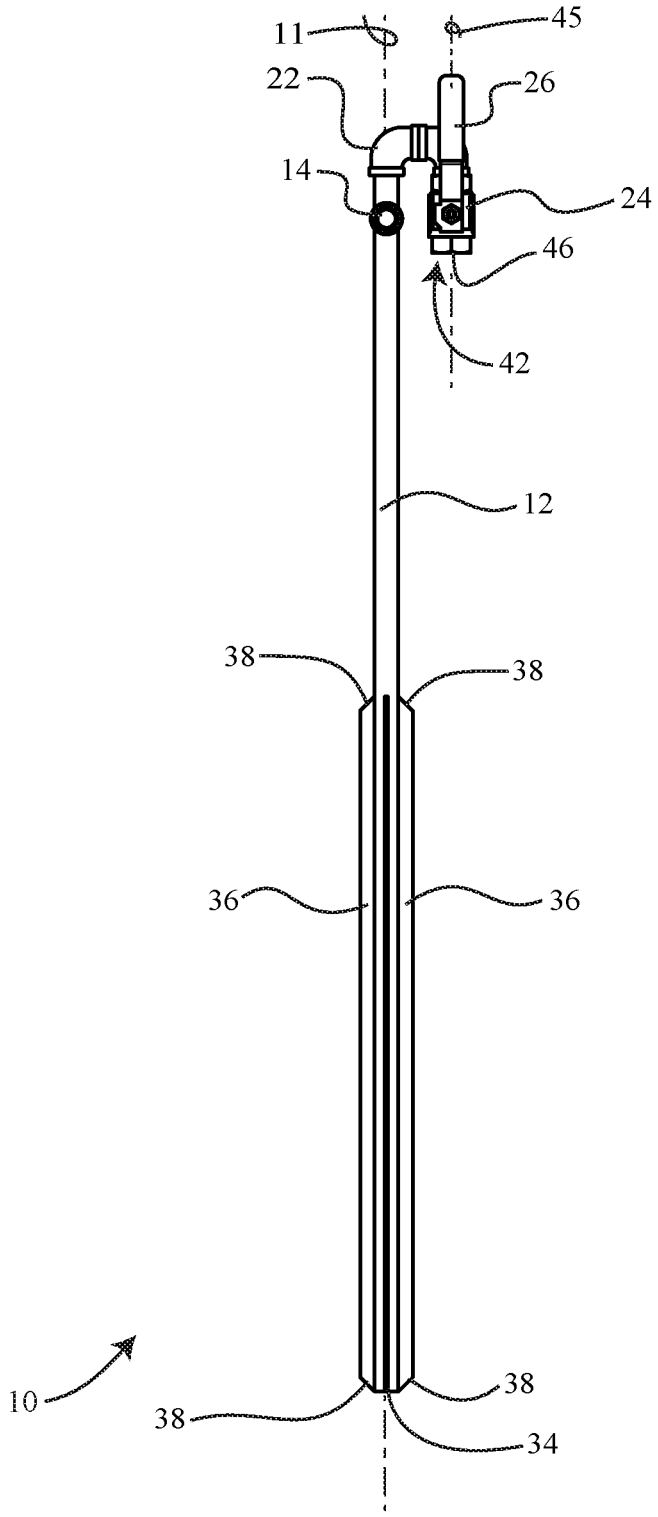
FIG. 4 is a side elevational view of the soil boring device of FIG. 1.
Figure 5:
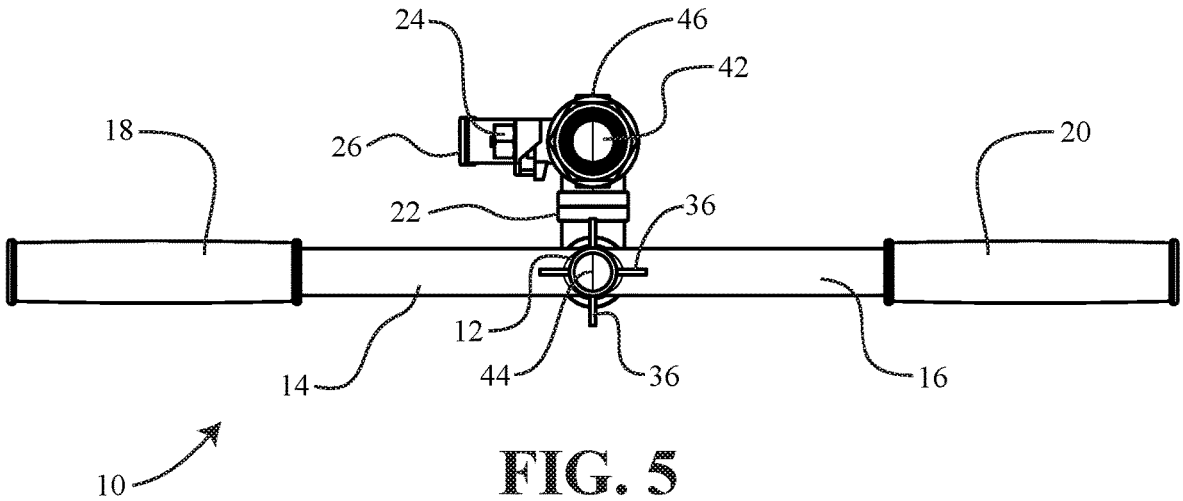
FIG. 5 is a bottom plan view of the soil boring device of FIG. 1.
Figure 6:
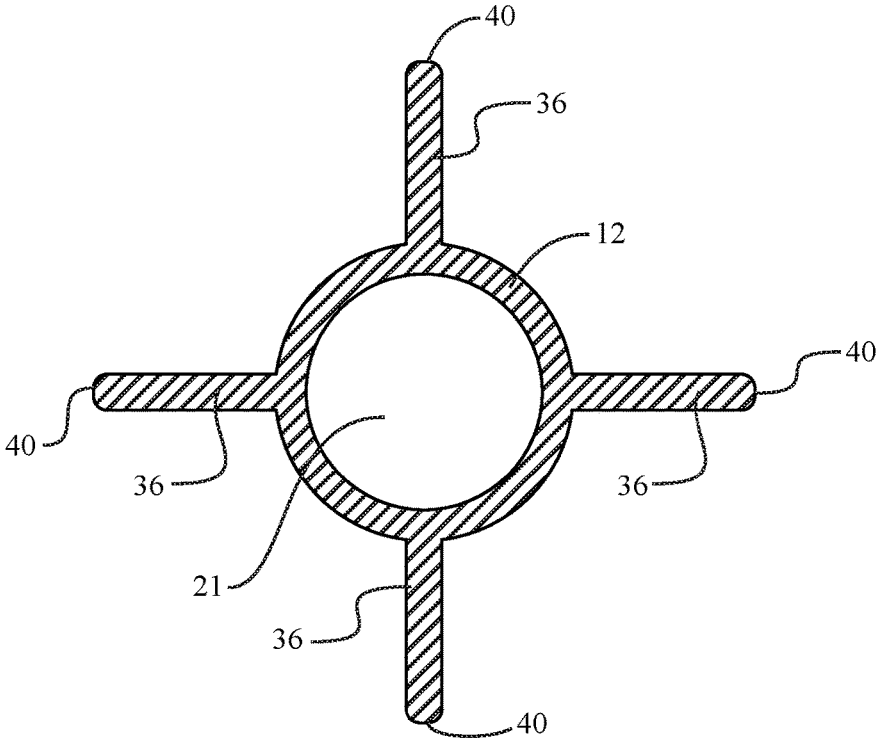
FIG. 6 is a transverse sectional view of the tubular body portion and fins of the soil boring device of FIG. 1, wherein the section is generally cut along the cutting-plane line A-A in FIG. 3.

Now, referring again to FIGS. 1-6, the elongate tubular body portion 12 and the fin members 36 of the illustrative soil boring device 10 will be described in further detail. In the illustrative embodiment, the fluid passageway 21 extends from the first end 32 of the elongate tubular body portion 12 to the water outlet 44 at the second end 34 of the elongate tubular body portion 12 (refer to FIG. 2). As shown in the illustrative embodiment, the elongate tubular body portion 12 of the soil boring device 10 further comprises an imperforate peripheral sidewall defining the fluid passageway 21 (see FIG. 1). That is, the peripheral sidewall of the elongate tubular body portion 12 of the soil boring device 10 does not contain any apertures disposed along the length thereof from the first end 32 to the second end 34. Rather, the elongate tubular body portion 12 only contains the fluid passageway inlet at the first end 32 and the fluid passageway outlet at the second end 34. With particular reference to the sectional view of FIG. 6, it can be seen that, in the illustrative embodiment, the fin members 36 are circumferentially spaced apart about a periphery of the outer surface of the elongate tubular body portion 12 (e.g., four (4) fin members 36 spaced approximately 90 degrees apart from one another). As shown in FIGS. 3, 4, and 6, in the illustrative embodiment, each of the fin members 36 comprises tapered end portions 38 and rounded edges 40. Advantageously, the rounded edges 40 of fin members 36 are configured to prevent the fin members 36 from cutting tree roots and damaging underground utility lines. In the illustrative embodiment, the tapered end portions 38 of the fin members 36 may be cut at approximately a 45 degree angle. Although, other suitable taper angles may be also be used in other embodiments of the invention.

While the soil boring device 10 is provided with four (4) fin members 36 in the illustrative embodiment, it is to be understood that the soil boring device 10 may be provided with a greater or smaller number of fin members 36 in other embodiments of the invention. For example, the inventor has contemplated that providing three (3) fin members 36 would leave more room for the slurry of water and loosened soil to rise up in the hole, while providing five (5) fin members 36 might knock the soil loose faster. Also, in other embodiments, the fin members 36 could be wavy and/or interrupted with spaces or gaps, rather than being straight continuous fin members 36 as in the illustrative embodiment.

Also, as used herein, the term "elongate tubular body portion" broadly refers to a hollow elongated body having a closed cross-section that is not limited to any specific cross-sectional shape. For example, rather than the generally circular cross-section of the illustrative embodiment, the elongate tubular body portion 12 could have a generally square cross-section, a generally rectangular cross-section, a generally elliptical cross-section, a polygonal cross-section, or any combination of these cross-sectional shapes.

Turning again to FIGS. 1-3 and 5, it can be seen that, in the illustrative embodiment, the first and second handle portions 14, 16 extend outwardly from the elongate tubular body portion 12 in respective opposite directions (e.g., each of the first and second handle portions 14, 16 may extend from an opposite side of the elongate tubular body portion 12 and be disposed generally perpendicular to the elongate tubular body portion 12). Also, in the illustrative embodiment, the first and second handle portions 14, 16 are disposed proximate to the first end 32 of the elongate tubular body portion 12. For example, as shown in FIG. 2, the first and second handle portions 14, 16 are located just below the first end 32 of the elongate tubular body portion 12. In the illustrative embodiment, referring to FIGS. 1-3, it can be seen that the first and second handle portions 14, 16 may be provided with respective first and second handle sleeve portions 18, 20 disposed thereon in order to provide gripping sleeves for the right and left hands of the user. For example, in one or more illustrative embodiments, the first and second handle sleeve portions 18, 20 may be formed from a suitable polymeric material, plastic, or rubber so as to provide a more comfortable gripping surface for the user. In one or more illustrative embodiments, the elongate tubular body portion 12 and the first and second handle portions 14, 16 are formed from a suitable metal, such as steel. For example, the first and second handle portions 14, 16 may be welded to the sides of the elongate tubular body portion 12.

In one or more alternative embodiments, for additional reinforcement, one or more gussets may be provided at the intersection of the first and second handle portions 14, 16 and the elongate tubular body portion 12. For example, a gusset plate may be welded at the intersection of the first and second handle portions 14, 16 and the elongate tubular body portion 12 for additional strength and to allow indicia to be printed thereon.

Figure 13:
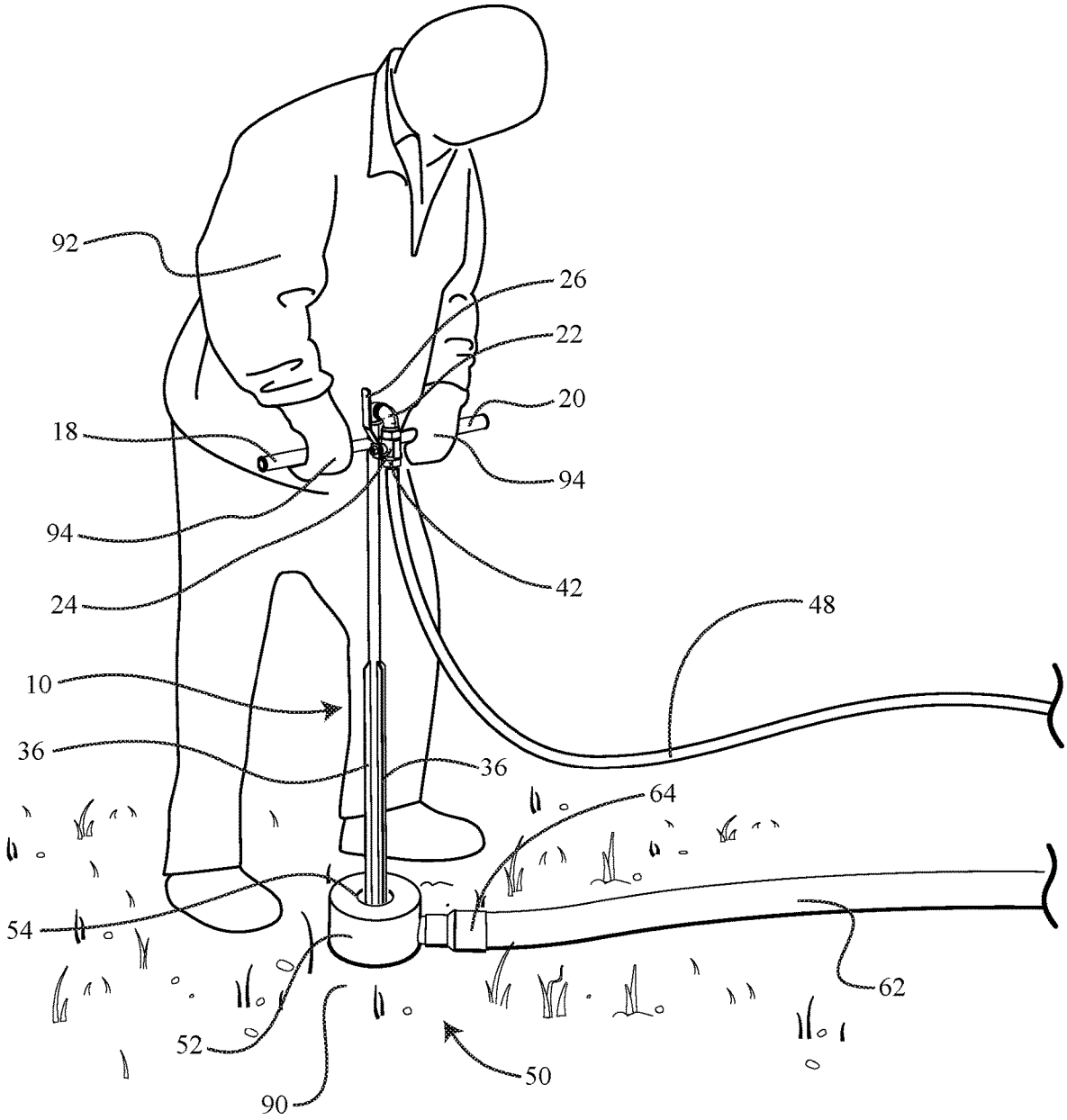
FIG. 13 is a perspective view illustrating a user forming a hole in the ground with the soil boring device, while the vacuum collar is being used to collect water and loosened soil at the top of the hole.

Next, with particular reference to FIGS. 1, 2, and 5, the water connection subassembly 22 of the illustrative soil boring device 10 will be explained in further detail. Initially, referring to the illustrative embodiment of FIG. 2, it can be seen that the water connection subassembly 22 generally comprises a water valve 24, a hose connector fitting 46 disposed upstream of the water valve 24, and a U-shaped connection 28, 30 disposed downstream of the water valve 24. The water valve 24 is configured to regulate the flow of water into the fluid passageway 21 of the elongate tubular body portion 12 (i.e., when the user rotates the valve handle 26 of the valve 24 from the horizontal "off" position of FIG. 7 to the vertical "on" position of FIGS. 1 and 13, as diagrammatically indicated by the curved arrow 27 in FIG. 7, water flows through the fluid passageway 21). The hose connector fitting 46 at the inlet of the valve 24 may comprise a threaded collar for allowing a water hose 48 to be connected to the soil boring device 10. The hose connector fitting 46 defines the water inlet 42 of the soil boring device 10. Also, as shown in the illustrative embodiment of FIGS. 1 and 2, the U-shaped connection of the water connection subassembly 22, which connects the water valve 24 to the first end 32 of the elongate tubular body portion 12, may comprise first and second pipe elbows 28, 30 that form a 180 degree change in the direction of the water flowing into the soil boring device 10. In the illustrative embodiment, the first and second pipe elbows 28, 30 may comprise 90 degree street elbows in order to minimize both (a) the distance between the centerline 11 of the device 10 and centerline 45 of the hose connection 46, and (b) the number of threaded connections, as compared to the distances and connections that would be required for two (2) elbows and two (2) connecting close pipe nipples.

Although, in other embodiments, rather than using two (2) 90 degree street elbows as in the illustrative embodiment, the U-shaped connection of the water connection subassembly 22 could be alternatively formed by a 180 degree elbow or 180 degree pipe bend.

Figure 1:
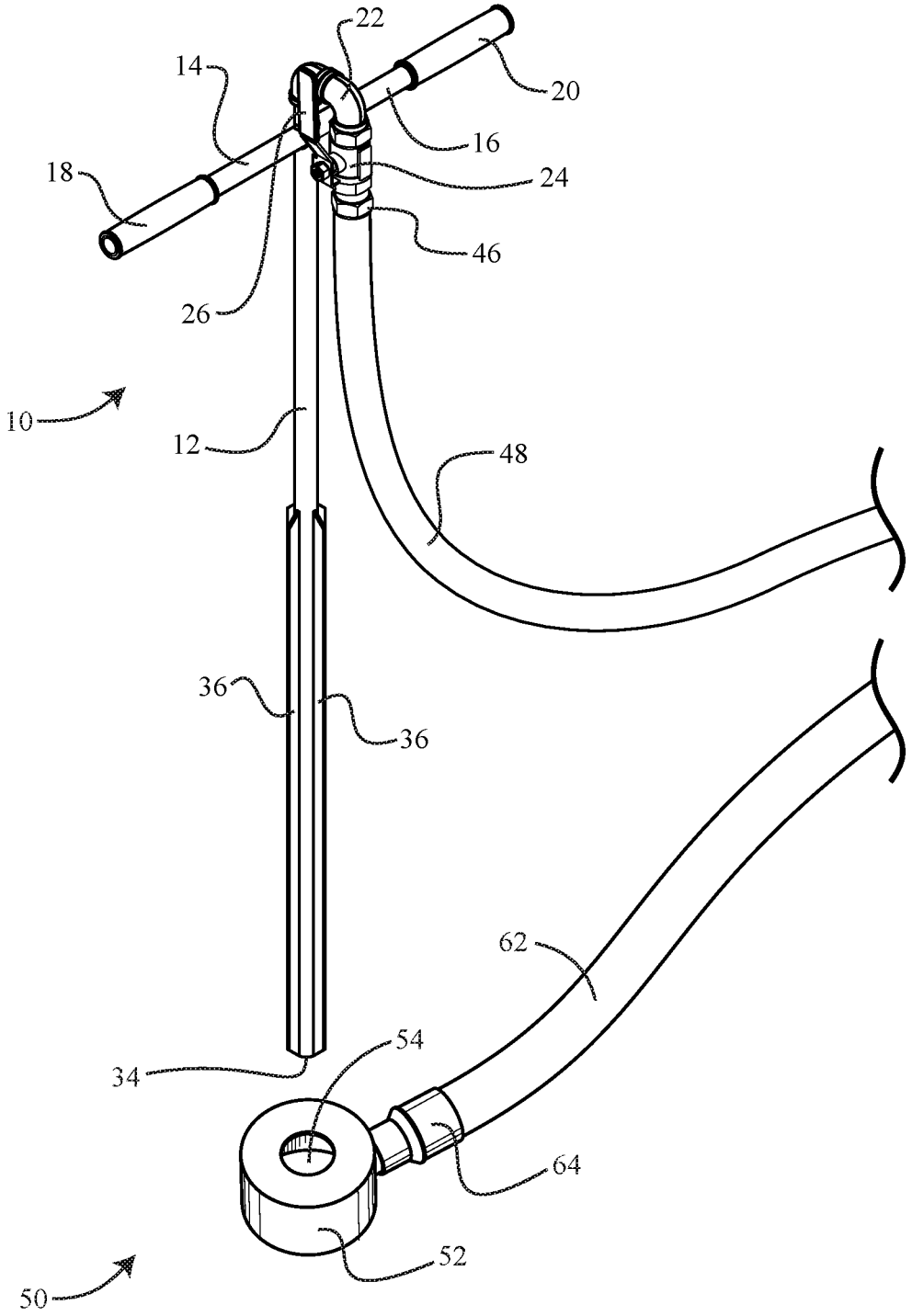
FIG. 1 is a assembled perspective view of a soil boring device and a vacuum collar, according to an illustrative embodiment of the invention.
Figure 7:
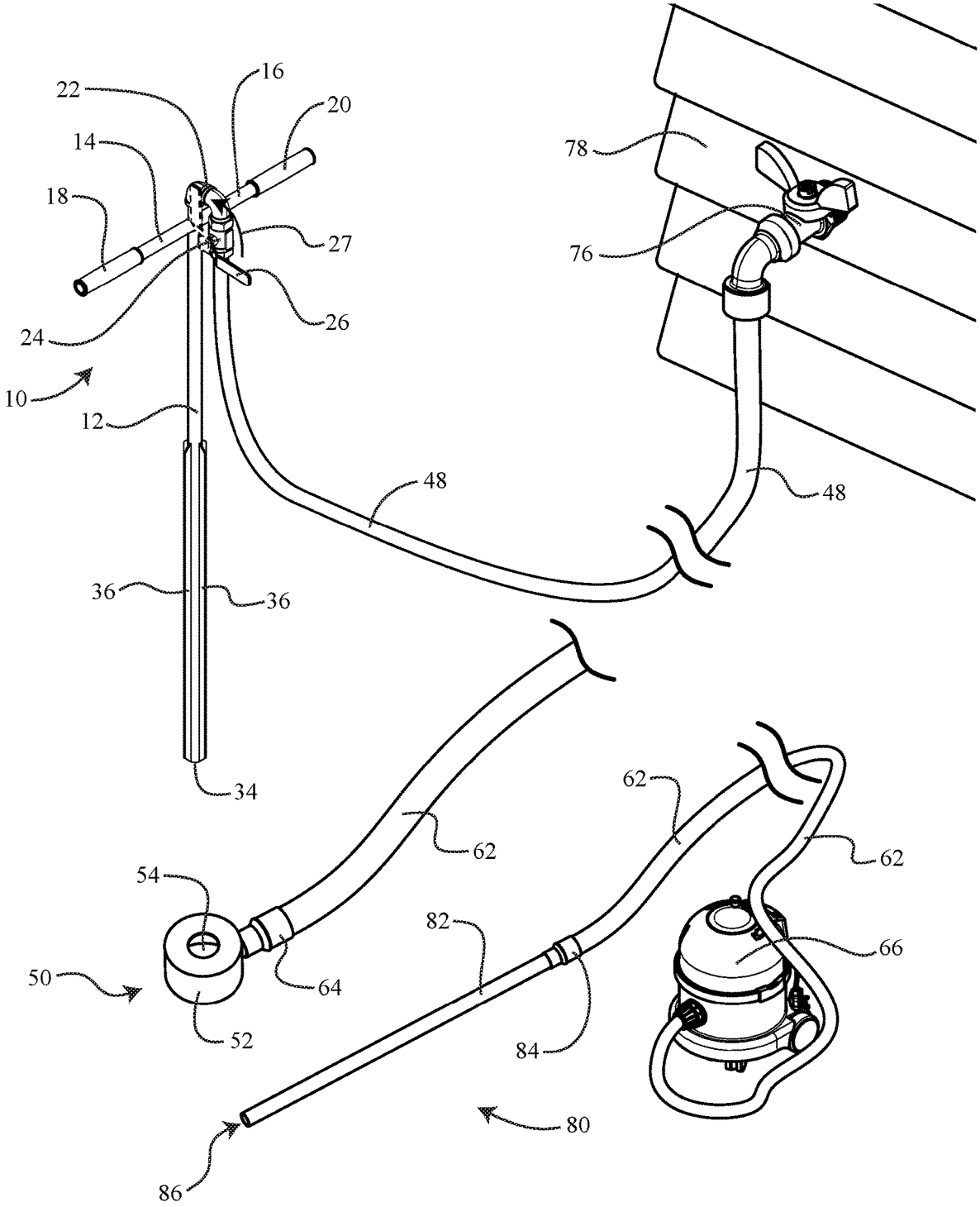
FIG. 7 is a perspective view of the soil boring kit of FIG. 2, according to an illustrative embodiment of the invention, wherein the soil boring device is shown connected to a hose bibb and the vacuum wand is shown connected to a wet-type shop vacuum cleaner.
Figure 8:
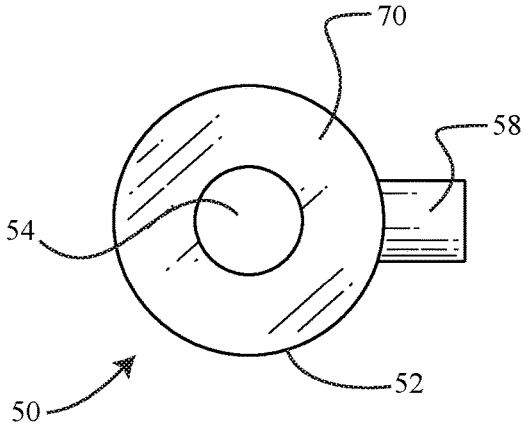
FIG. 8 is a top plan view of the vacuum collar of FIG. 1.

Referring again to FIG. 4, in the illustrative embodiment, it can be seen that a central axis 45 of the hose connector fitting 46 is disposed generally parallel to, and closely spaced apart from, the centrally disposed longitudinal axis 11 of the elongate tubular body portion 12 so as to minimize the inertial forces resulting from the weight of a water hose connected to the soil boring device 10 (i.e., the weight of the water hose 48 in FIGS. 1 and 7). Advantageously, together with the parallel relationship between the axes 11, 45, the minimization of the distance between the hose connection 46 and the elongate tubular body portion 12 of the soil boring device 10 significantly minimizes the inertial resistance to the rotation of the soil boring device 10 that is described hereinafter. As such, it is desired that center-to-center distance of the U-connection be minimized so that the water filled hose swings through the smallest arc as practicable. The inertial resistance to rotating the device 10 results from the weight of the water and hose swinging through an arc. As such, locating the hose closer to the device 10 reduces the inertial resistance to rotation. The inertial resistance to rotation of the device 10 is generally attributable to the weight of the water and hose, rather than the flowing of the water through the hose.

In one example embodiment, the soil boring device 10 may have an overall length of approximately forty-two (42) inches and a width at the handle portions 14, 16 of approximately twenty-one (21) inches. In this example embodiment, the outside diameter of the elongate tubular body portion 12 of the soil boring device 10 is approximately 0.84 inches, and each of the four (4) fins 36 disposed on the elongate tubular body portion 12 of the soil boring device 10 is approximately one-half (½) of an inch wide by twenty-four (24) inches long. In this example embodiment, the hose connector fitting 46 is configured to connect to a typical garden hose and the water valve 24 is in the form of a quarter-turn, ball-type shut-off valve. Also, in this example embodiment, the U-shaped bend of the water connection subassembly 22 is based on a two (2) inch centerline (e.g., two (2) inches between the central axis 45 of the hose connector fitting 46 and the centrally disposed longitudinal axis 11 of the elongate tubular body portion 12). In addition, in this example embodiment, the diameter of the water outlet 44 at the tip of the device 10 may be in the range between approximately 0.125 inches to approximately 0.625 inches, or in the range between approximately 0.125 inches to approximately 0.250 inches. These dimensions and component types merely are given as examples herein and, as such, it is to be understood the soil boring device 10 may have other suitable dimensions and use other suitable component types in other embodiments of the invention.

In order to facilitate the collection and removal of the water and loosened soil from the hole 96 being formed in the ground 90 (e.g., see FIG. 15), the soil boring device 10 of the illustrative embodiment described above may be provided as part of a soil boring kit 100. In addition to the soil boring device 10, the illustrative soil boring kit 100 also may comprise a vacuum collar 50 (see e.g., FIGS. 1 and 2) and a vacuum wand 80 (see e.g., FIGS. 2 and 7). The vacuum collar 50 and the vacuum wand 80 of the soil boring kit 100 will be described hereinafter.

Figure 9:
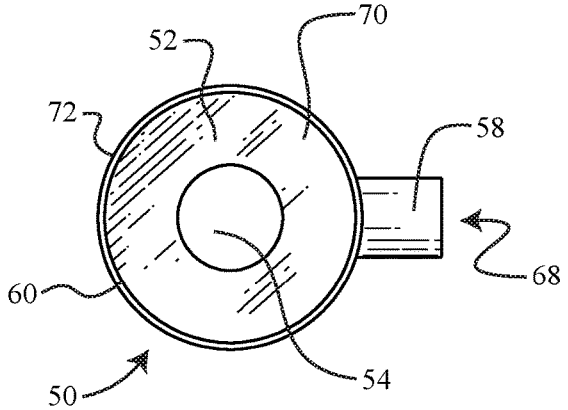
FIG. 9 is a bottom plan view of the vacuum collar of FIG. 1.
Figure 10:
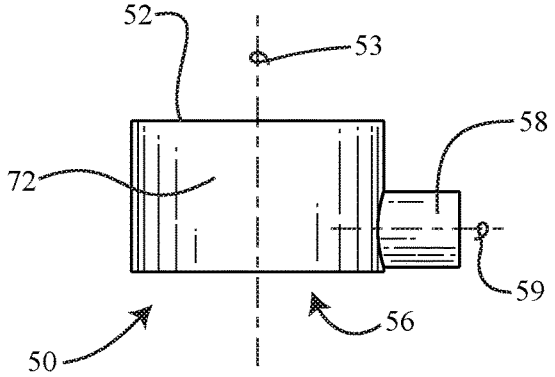
FIG. 10 is a side elevational view of the vacuum collar of FIG. 1.
Figure 11:
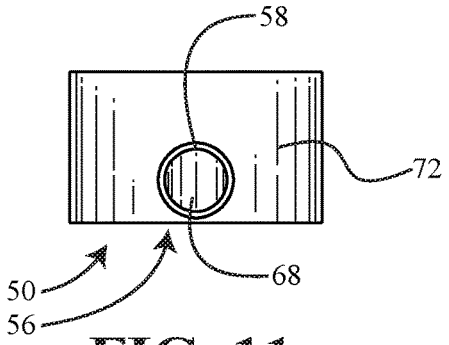
FIG. 11 is a rear elevational view of the vacuum collar of FIG. 1.
Figure 12:
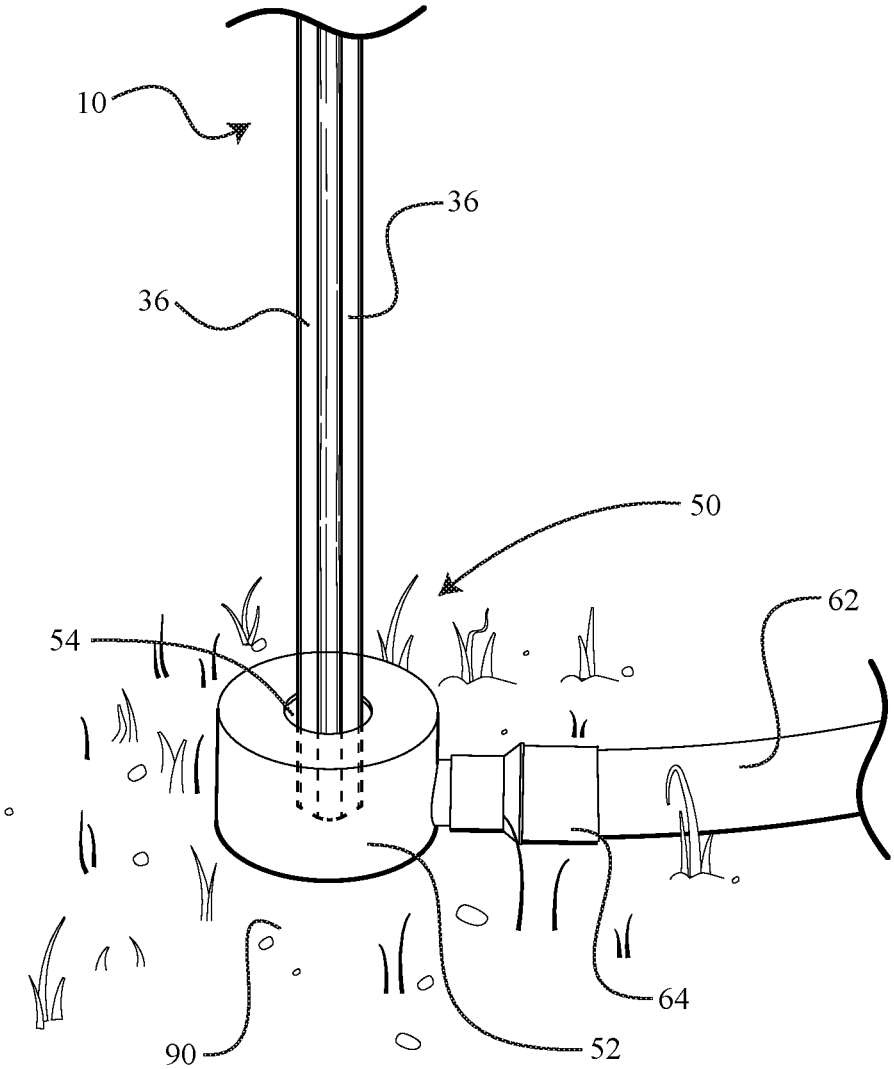
FIG. 12 is a perspective view illustrating the vacuum collar being disposed around the soil boring device so as to collect water and loosened soil at the top of the hole being bored in the ground.

Now, with particular reference to FIGS. 1, 2, and 8-11, the vacuum collar 50 of the illustrative soil boring kit 100 will be described. As mentioned above, the vacuum collar 50 is configured to collect and extract water and loosened soil from a top of a hole 96 in the ground 90 (see FIG. 15). In the illustrative embodiment, referring to FIGS. 8-11, the vacuum collar 50 includes a cylindrical hollow body portion 52, the cylindrical hollow body portion 52 defining an internal cavity configured to receive the water and loosened soil at the top of the hole 96 (refer to FIG. 15), the cylindrical hollow body portion 52 defining an aperture 54 in a top end wall 70 thereof, the aperture 54 configured to receive a portion of the elongate tubular body portion 12 of the soil boring device 10 passing therethrough (see FIGS. 12 and 15); and a vacuum hose connection member 58 extending outwardly from the cylindrical hollow body portion 52, the vacuum hose connection member 58 configured to fluidly couple the vacuum collar 50 to a vacuum source (e.g., a wet-type shop vacuum cleaner 66—refer to FIG. 7) via a vacuum hose 62 so as to enable the water and loosened soil in the internal cavity of the cylindrical hollow body portion 52 to be extracted from the vacuum collar 50. Also, in the illustrative embodiment, it can be seen that the cylindrical hollow body portion 52 of the vacuum collar 50 further comprises an open bottom 56 disposed opposite to the top end wall 70 (see FIGS. 10 and 15), the open bottom 56 of the vacuum collar 50 configured to be disposed against the ground 90 at the top of the hole 96 in the ground 90 (refer to FIG. 15). In FIG. 9, it can be seen that the annular bottom edge 60 of the circular sidewall 72 of the vacuum collar cylindrical hollow body portion 52 defines the periphery of the open bottom 56 of the vacuum collar 50. As shown in FIG. 10, the vacuum hose connection member 58 penetrates the circular sidewall 72 of the vacuum collar 50 near the annular bottom edge 60 of the circular sidewall 72.

Referring again to FIG. 10, it can be seen that, in the illustrative embodiment, the vacuum hose connection member 58 of the vacuum collar 50 has a central axis 59 that is disposed generally perpendicular to a centrally disposed axis 53 of the cylindrical hollow body portion 52 of the vacuum collar 50. Also, in the illustrative embodiment, as best shown in FIGS. 1, 7, 12, and 13, the vacuum hose 62 is connected to the vacuum hose connection member 58 of the vacuum collar 50 by a hose connector fitting 64 (e.g., the hose connector fitting 64 engages the outer periphery of the vacuum hose connection member 58 by means of a generally airtight slip-fit connection). When the vacuum hose 62 is connected to the vacuum collar 50 by means of the frictional engagement between the components 58, 64, water and loosened soil are drawn through the open bottom 56 of the vacuum collar 50, and then are evacuated from the vacuum collar 50 through the outlet opening 68 defined by the vacuum hose connection member 58 (see FIG. 11). As shown in the exploded view of FIG. 2, in the illustrative embodiment, the vacuum hose 62 may also comprise an outlet fitting 74 for coupling the hose 62 to the vacuum source (e.g., wet-type shop vacuum cleaner 66), which is located at an end of the hose 62 opposite to the hose connector fitting 64.

Figure 15:
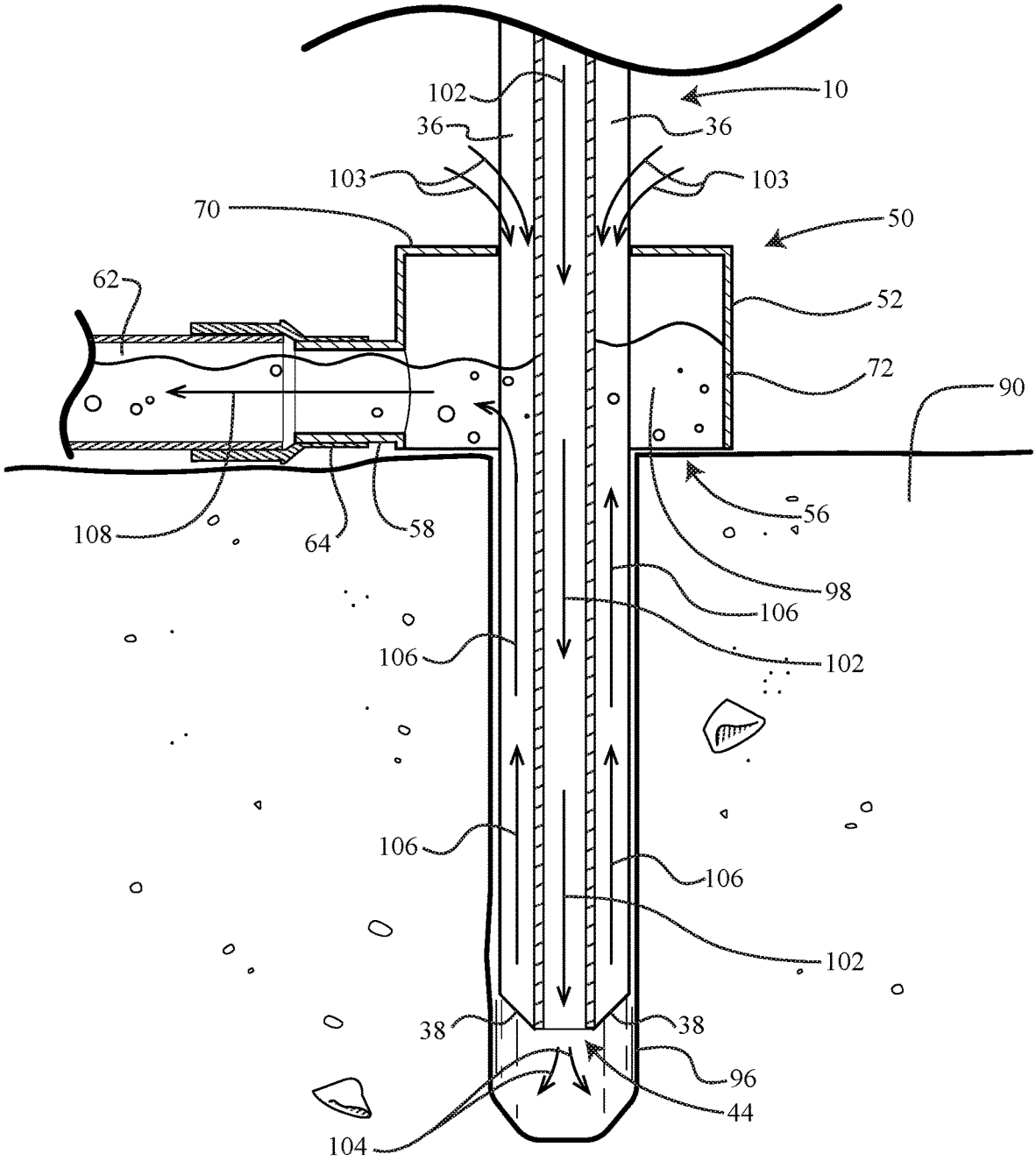
FIG. 15 is a longitudinal section view cut through the bored hole, soil boring device, and vacuum collar so as to illustrate the forming of the hole with the soil boring device.

In the illustrative embodiment, once the vacuum collar 50 is placed over the hole 96, air 103 pulled by the vacuum source 66 enters at the top of collar 50 between the shaft of the soil boring device 10 and the top end wall 70 at high velocity (as shown in FIG. 15). Air hits the top of the slurry of water and loosened soil coming out of hole 96. As such, almost all the slurry of water and loosened soil in the vacuum collar 50 is suspended in turbulent air which exits the collar 50 via vacuum hose 62. Then, the slurry of water and loosened soil is pushed from the vacuum collar 50 to the collection vessel of the vacuum source 66 via high velocity air in the vacuum hose 62.

In one example embodiment, the vacuum collar 50 may have an outside diameter of approximately five (5) inches and the aperture 54 in the top end wall 70 may have a diameter of approximately two (2) inches. In this example embodiment, the hose connection member 58 has an outside diameter of approximately one and one-half (1.5) inches and a length of approximately one and one-half (1.5) inches. These dimensions merely are given as examples herein and, as such, it is to be understood the vacuum collar 50 may have other suitable dimensions in other embodiments of the invention.

In other embodiments, rather than using a wet-type shop vacuum cleaner 66 as depicted in the illustrative embodiment, the vacuum hose 62 may alternatively be connected to a large skid-mounted, trailer-mounted, or truck-mounted vacuum/containment vessel unit, which could significantly speed up the slurry collection process described herein.

Figure 18:
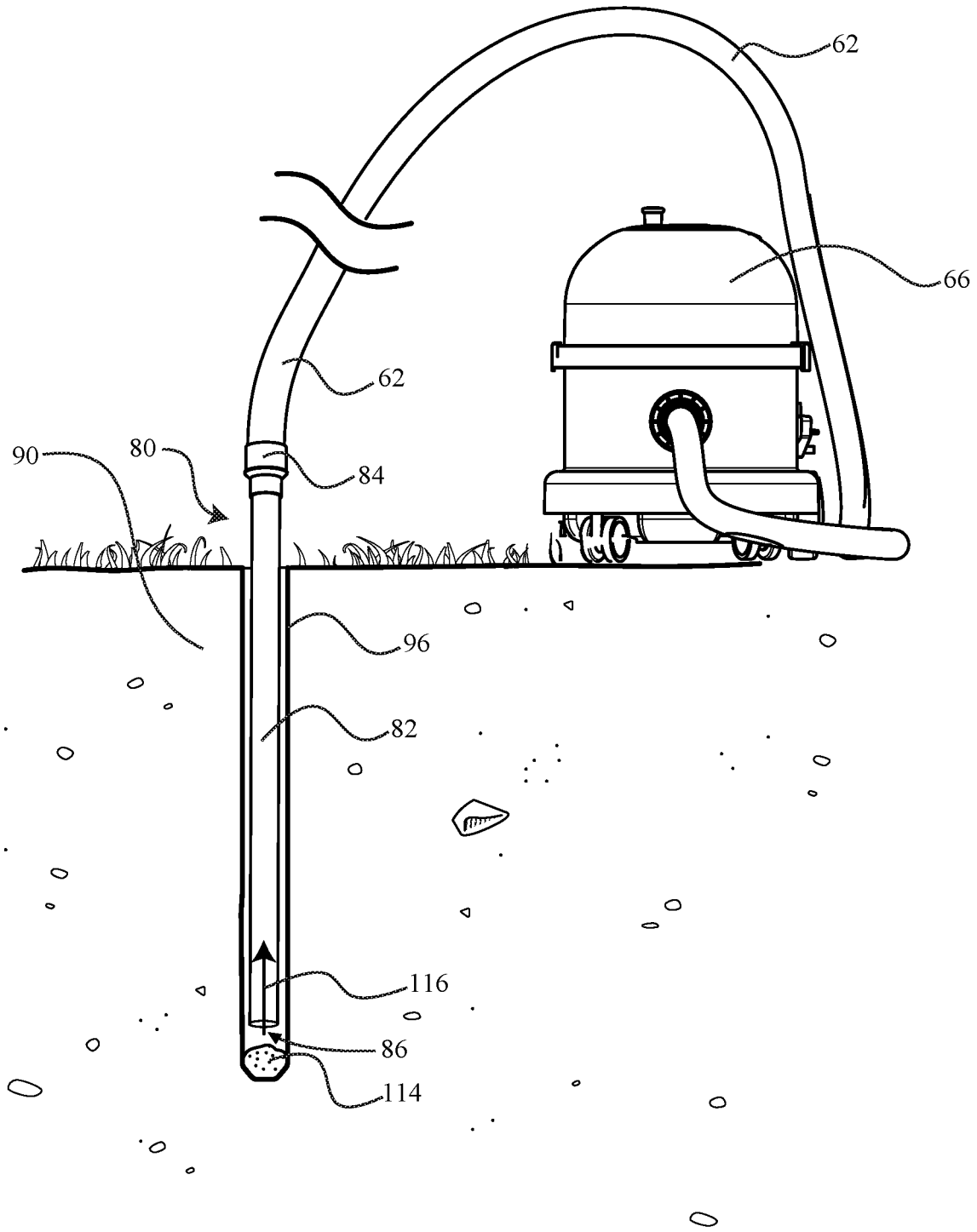
FIG. 18 is another sectional view cut through the hole formed in the ground, wherein the vacuum wand of the soil boring kit is shown being used to remove water and loosened soil from inside the hole.

Next, referring particularly to FIGS. 2, 7, and 18, the vacuum wand 80 of the illustrative soil boring kit 100 will be explained. In the illustrative embodiment, referring to FIGS. 7 and 18, the vacuum wand 80 includes a wand elongate tubular body portion 82 that is configured to be inserted into the hole 96 in the ground 90 (see FIG. 18). As shown in FIG. 2, the wand elongate tubular body portion 82 of the vacuum wand 80 comprises a vacuum inlet 86 disposed at a first end of the wand elongate tubular body portion 82 and a vacuum outlet 88 disposed at a second end of the wand elongate tubular body portion 82 that is opposite to the first end. The vacuum outlet 88 of the wand elongate tubular body portion 82 is configured to be fluidly coupled to the vacuum source 66 so as to create a suction force in the wand elongate tubular body portion 82, and the vacuum inlet 86 of the wand elongate tubular body portion 82 is configured to extract the water and loosened soil from the hole 96 in the ground 90 as a result of the suction force created by the vacuum source 66. As shown in FIGS. 2 and 7, in the illustrative embodiment, the second end of the wand elongate tubular body portion 82 comprises a connector fitting 84 to couple the vacuum wand 80 to the vacuum hose 62. As shown in FIGS. 2 and 7, the vacuum collar 50 and the vacuum wand 80 of the illustrative embodiment are configured to be interchangeably connected to the vacuum source 66 (e.g., by selectively attaching the vacuum hose 62 of the vacuum source 66 to either the vacuum collar 50 by means of connector fitting 64 or to the vacuum wand 80 by means of connector fitting 84). In an alternative embodiment, the vacuum wand 80 may simply comprise the wand elongate tubular body portion 82 without the connector fitting 84. In this alternative embodiment, the wand elongate tubular body portion 82 is connected to the hose connector fitting 64, which remains affixed to the vacuum hose 62 so that it can be interchangeably connected to either the vacuum collar 50 or the vacuum wand 80.

In one example embodiment, the vacuum wand 80 may have an outside diameter of approximately one and one-half (1½) inches and an overall length of approximately thirty-six (36) inches. These dimensions merely are given as examples herein and, as such, it is to be understood the vacuum collar 50 may have other suitable dimensions in other embodiments of the invention.

Figure 16:
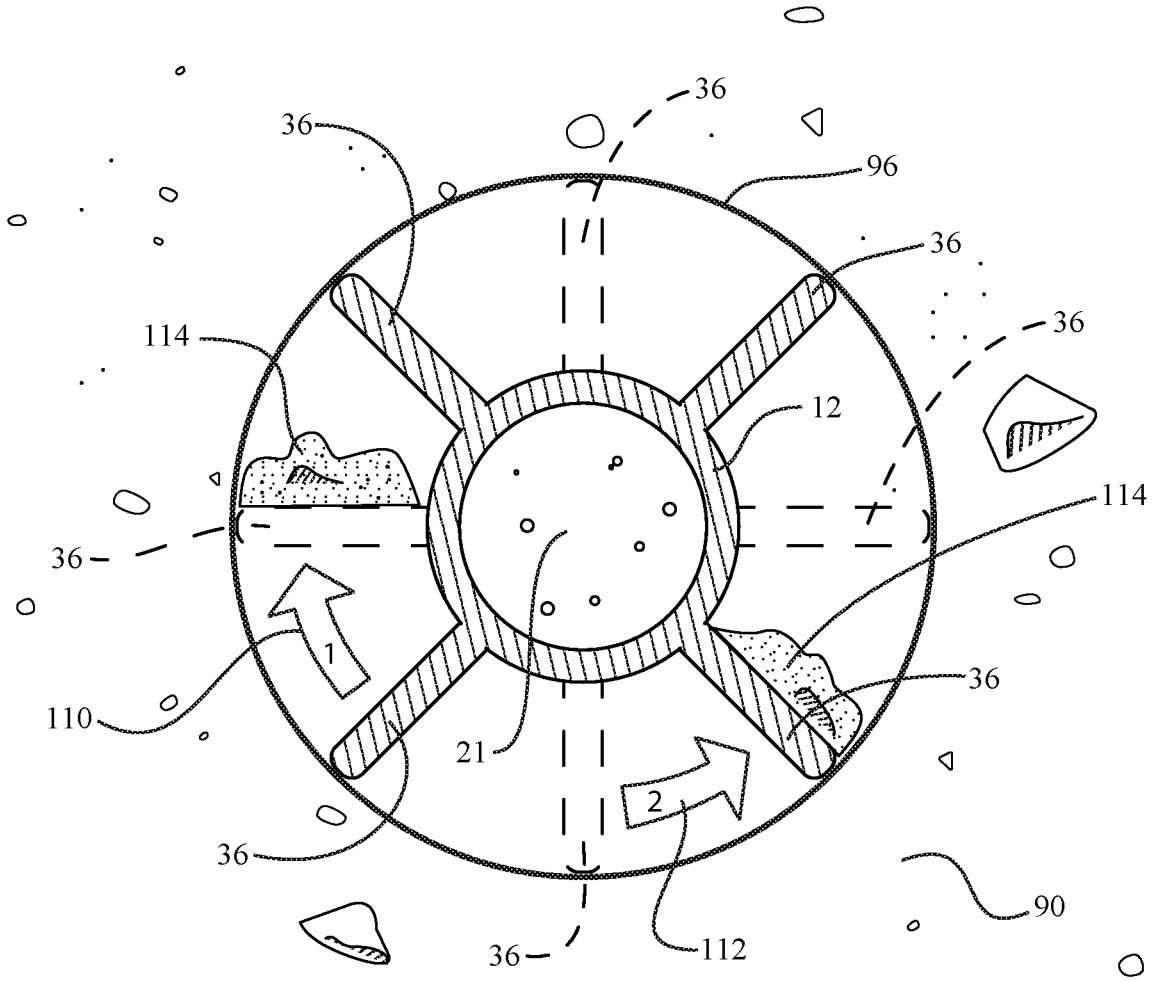
FIG. 16 is another transverse sectional view of the tubular body portion and fins of the soil boring device of FIG. 1, wherein the manner in which the fins of the device are used to loosen soil is illustrated.
Figure 17:
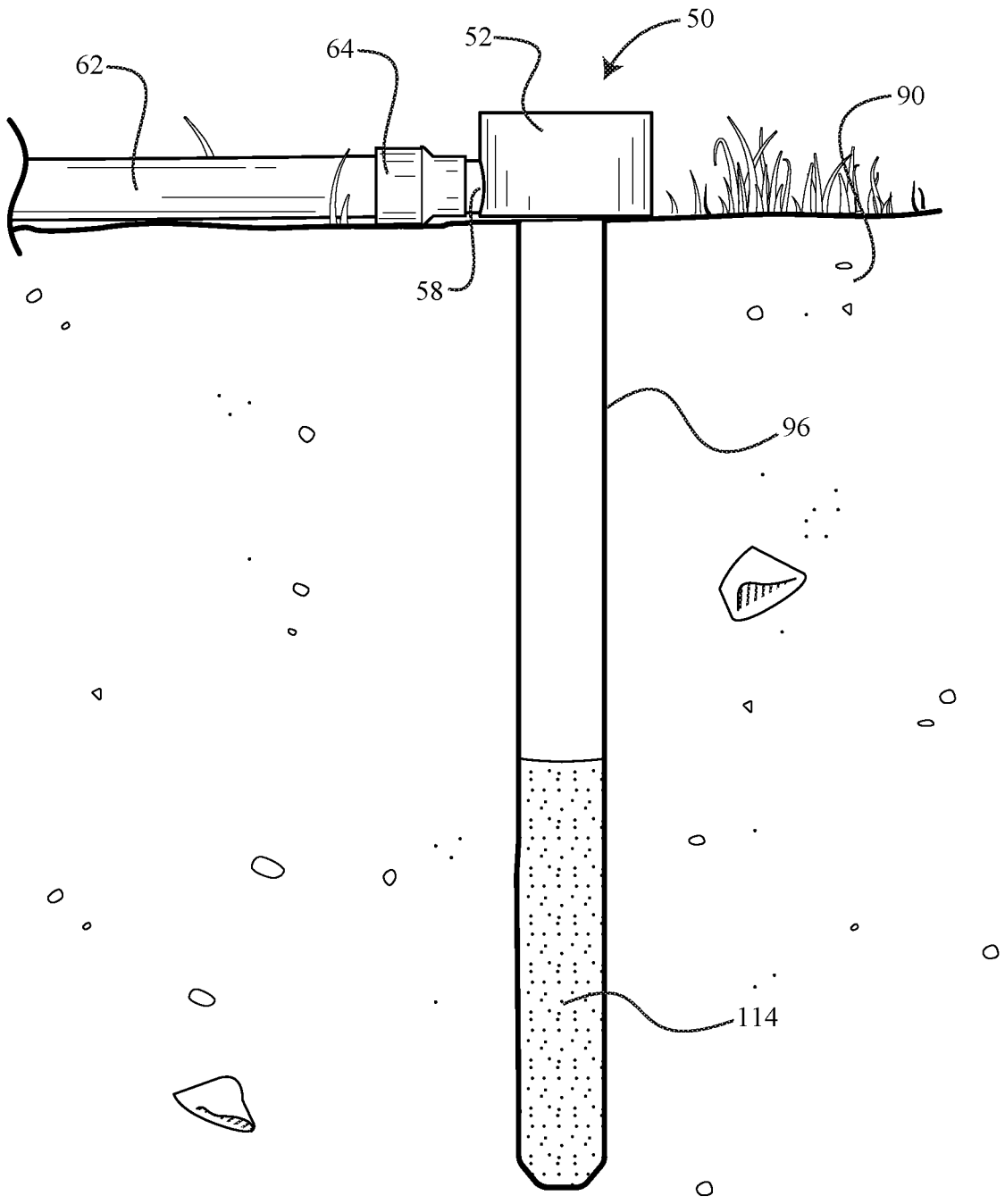
FIG. 17 is a sectional view cut through the hole formed in the ground, wherein the vacuum collar of the soil boring kit is shown disposed over the top of the hole.

Now, the manner in which the illustrative soil boring kit 100 is utilized by a user will be described in detail. Initially, with the vacuum source activated (e.g., wet vacuum 66 turned "on"), the user 92 places the vacuum collar 50 on the ground 90 at the spot where the hole 96 is to be bored. Then, the user places the tip of the soil boring device 10 through the vacuum collar 50 allowing it to rest on the ground 90 (refer to FIG. 12). Then, the user 92 opens the water valve 24 on the soil boring device 10 from the horizontal "off" position of FIG. 7 to the vertical "on" position of FIGS. 1 and 13. Because the water source supplying the water hose 48 is already turned "on", the water flows into the fluid passageway 21 of the soil boring device 10 once the water valve 24 is opened by the user 92. For example, in the illustrative embodiment, the water may be supplied to the water hose 48 by a hose bibb 76 on the outside wall 78 of a dwelling structure. Once water is being supplied to the soil boring device 10, the user 92 rotates the soil boring device 10 alternately clockwise and counter-clockwise (see FIGS. 13, 14*a*, and 14*b*) while placing moderate downward pressure on the soil boring device 10 (e.g., the rotation of the soil boring device 10 is diagrammatically represented by the arrow A1 in FIG. 14*a* and the oppositely disposed arrows 110, 112 loosening soil 114 in FIG. 16). As shown in FIG. 15, the water emerging from the tip of the soil boring device 10 softens the soil ahead of the device 10, allowing the soil to be knocked loose by the fins 36 which establish the inside diameter of the hole 96. In FIG. 15, it can be seen that the water flows down the central fluid passageway 21 of the soil boring device 10 (as diagrammatically represented by the downward arrows 102), emerges from the water outlet 44 at the tip of the device 10 (as diagrammatically represented by the curved arrows 104), and then flows upward together with the excavated material along the shaft 12 of the device 10 (as diagrammatically represented by the upward arrows 106). That is, the slurry of water and excavated soil are forced up the voids between the fins 36 of the soil boring device 10 to the surface of the ground 90 (see FIG. 15), where the slurry of water and excavated soil 98 is carried from the vacuum collar 50 (as diagrammatically represented by the horizontal arrow 108) via the vacuum hose 62 to the collection vessel (e.g., the collection vessel of the wet vacuum 66). The rate of advance of the soil boring device 10 is dependent on the soil conditions (i.e., the composition and compaction of the soil). When the desired depth of the hole 96 is reached or an obstacle is encountered, the water valve 24 on the soil boring device 10 is closed and device 10 is withdrawn from the hole 96. The remaining slurry of water and excavated soil 114 in the bottom of the hole 96 (see e.g., FIG. 17) is removed with the vacuum wand 80. As shown in FIG. 18, the straight tubular body portion 82 of the vacuum wand 80 is inserted into the hole 96, and the remaining slurry of water and excavated soil 114 is removed from the hole 96 by the suction force of the vacuum source 66 (as diagrammatically represented by the upward arrow 116).

In the illustrative embodiment, the soil boring device 10 may be configured to form holes in the ground with a diameter between approximately two (2) inches and approximately three (3) inches, and a depth between approximately eight (8) inches and approximately forty-eight (48) inches. Although, in other embodiments, the soil boring device 10 may be configured to form holes having larger diameters and depths, such as holes having diameters between four (4) inches and eight (8) inches with depths greater than forty-eight (48) inches.

Although, the soil boring device 10 of the illustrative embodiment is supplied by water from hose bibb 76 that uses typical residential water pressure, the soil boring device 10 may also use higher pressure water supplies as well. For example, the inventor has also envisioned a higher pressure version of the soil boring device 10 that is powered by either the typical sprayers used by arborists (which are on the order of 500 psi), or by pressure washer type units (which generate on the order of 2,000 to 4,000 psi). A soil boring device 10 utilizing either of these higher pressure water supplies would still incorporate all of the primary features of the soil boring device 10, such as the fins 36 and the proximity of the supply hose connection 46 to the main shaft 12 of the device 10.

It is readily apparent that the aforedescribed soil boring device 10 and the kit 100 including the soil boring device 10 offers numerous advantages. First, the soil boring device 10 described above is easy to use, thus facilitating the forming of holes in the ground. The soil boring device 10 advantageously makes a "clean" hole (i.e., round, straight hole) without glazing the walls of the hole or compacting the surrounding soil. Secondly, the soil boring device 10 does not contain sharp cutting edges so as to minimize the likelihood that any tree roots and underground utility lines will be damaged. Also, when low-pressure water is used for the soil boring device 10, the roots and underground utility lines do not sustain damage as a result of high-pressure fluid streams. Finally, the soil boring kit 100, which includes the soil boring device 10, collects a majority of the excavated material so as to minimize any subsequent clean-up that is required by the user. That is, when the vacuum collar 50 is used with the soil boring device 10, the vacuum collar 50 collects virtually all of the slurry of water and excavated soil resulting from the boring of the hole. Also, advantageously, the soil boring device 10 and the soil boring kit 100 including the same are able to be made inexpensively enough so as to allow "do-it-yourselfers" to treat their own plants.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A soil boring device for forming a hole in the ground, comprising:

an elongate tubular body portion having a first end and a second end disposed opposite to the first end, the elongate tubular body portion defining a fluid passageway disposed therein, the elongate tubular body portion further defining a water outlet fluidly coupled to the fluid passageway for discharging water from the soil boring device;

at least one fin member protruding from an outer surface of the elongate tubular body portion, the at least one fin member configured to loosen soil when the soil boring device is rotated about a centrally disposed longitudinal axis of the elongate tubular body portion by a user, the at least one fin member comprising tapered end portions and rounded edges, the rounded edges of the at least one fin member configured to prevent the at least one fin member from cutting tree roots and damaging underground utility lines;

at least one handle portion extending outwardly from the elongate tubular body portion, the at least one handle portion configured to be grasped by the user while the user is rotating the soil boring device about the centrally disposed longitudinal axis; and a water connection subassembly coupled to the elongate tubular body portion, the water connection subassembly defining a water inlet for supplying water to the fluid passageway of the elongate tubular body portion;

wherein the soil boring device is configured to discharge water from the water outlet of the elongate tubular body portion so as to moisten soil adjacent to the soil boring device, thereby facilitating the forming of the hole in the ground by allowing the soil to be more easily loosened by the at least one fin member.

2. The soil boring device according to claim 1, wherein the fluid passageway extends from the first end of the elongate tubular body portion to the water outlet at the second end of the elongate tubular body portion; and wherein the elongate tubular body portion further comprises an imperforate peripheral sidewall defining the fluid passageway.

3. The soil boring device according to claim 1, wherein the at least one fin member comprises a plurality of fin members, the plurality of fin members being circumferentially spaced apart about a periphery of the outer surface of the elongate tubular body portion.

4. The soil boring device according to claim 1, wherein the at least one handle portion comprises a first handle portion and a second handle portion, the first and second handle portions extending outwardly from the elongate tubular body portion in respective opposite directions, and the first and second handle portions being disposed proximate to the first end of the elongate tubular body portion.

5. The soil boring device according to claim 1, wherein the water connection subassembly comprises a water valve configured to regulate the flow of water into the fluid passageway of the elongate tubular body portion, and the water connection subassembly further comprising a hose connector disposed upstream of the water valve, the hose connector defining the water inlet of the soil boring device.

6. The soil boring device according to claim 5, wherein the water connection subassembly further comprises a U-shaped connection between the water valve and the first end of the elongate tubular body portion.

7. The soil boring device according to claim 5, wherein a central axis of the hose connector is disposed generally parallel to, and closely spaced apart from, the centrally disposed longitudinal axis of the elongate tubular body portion so as to minimize the inertial forces resulting from the weight of a water hose connected to the soil boring device.

8. A soil boring kit, comprising:

a soil boring device for forming a hole in the ground, the soil boring device including:

an elongate tubular body portion having a first end and a second end disposed opposite to the first end, the elongate tubular body portion defining a fluid passageway disposed therein, the elongate tubular body portion further defining a water outlet fluidly coupled to the fluid passageway for discharging water from the soil boring device;

at least one fin member protruding from an outer surface of the elongate tubular body portion, the at least one fin member configured to loosen soil when the soil boring device is rotated about a centrally disposed longitudinal axis of the elongate tubular body portion by a user;

at least one handle portion extending outwardly from the elongate tubular body portion, the at least one handle portion configured to be grasped by the user while the user is rotating the soil boring device about the centrally disposed longitudinal axis; and a water connection subassembly coupled to the elongate tubular body portion, the water connection subassembly defining a water inlet for supplying water to the fluid passageway of the elongate tubular body portion;

wherein the soil boring device is configured to discharge water from the water outlet of the elongate tubular body portion so as to moisten soil adjacent to the soil boring device, thereby facilitating the forming of the hole in the ground by allowing the soil to be more easily loosened by the at least one fin member; and a vacuum collar configured to collect and extract water and loosened soil from a top of the hole in the ground, the vacuum collar including:

a hollow body portion, the hollow body portion defining an internal cavity configured to receive the water and loosened soil at the top of the hole, the hollow body portion defining an aperture in an end wall thereof, the aperture configured to receive a portion of the elongate tubular body portion of the soil boring device passing therethrough; and a vacuum hose connection member extending outwardly from the hollow body portion, the vacuum hose connection member configured to fluidly couple the vacuum collar to a vacuum source so as to enable the water and loosened soil in the internal cavity of the hollow body portion to be extracted from the vacuum collar.

9. The soil boring kit according to claim 8, wherein the fluid passageway of the soil boring device extends from the first end of the elongate tubular body portion to the water outlet at the second end of the elongate tubular body portion; and wherein the elongate tubular body portion further comprises an imperforate peripheral sidewall defining the fluid passageway.

10. The soil boring kit according to claim 8, wherein the at least one fin member of the soil boring device comprises a plurality of fin members, the plurality of fin members being circumferentially spaced apart about a periphery of the outer surface of the elongate tubular body portion.

11. The soil boring kit according to claim 8, wherein the at least one fin member of the soil boring device comprises tapered end portions and rounded edges, the rounded edges of the at least one fin member configured to prevent the at least one fin member from cutting tree roots and damaging underground utility lines.

12. The soil boring kit according to claim 8, wherein the at least one handle portion of the soil boring device comprises a first handle portion and a second handle portion, the first and second handle portions extending outwardly from the elongate tubular body portion in respective opposite directions, and the first and second handle portions being disposed proximate to the first end of the elongate tubular body portion.

13. The soil boring kit according to claim 8, wherein the water connection subassembly of the soil boring device comprises a water valve configured to regulate the flow of water into the fluid passageway of the elongate tubular body portion, and the water connection subassembly further comprises a hose connector disposed upstream of the water valve, the hose connector defining the water inlet of the soil boring device.

14. The soil boring kit according to claim 13, wherein the water connection subassembly of the soil boring device further comprises a U-shaped connection between the water valve and the first end of the elongate tubular body portion.

15. The soil boring kit according to claim 13, wherein a central axis of the hose connector is disposed generally parallel to, and closely spaced apart from, the centrally disposed longitudinal axis of the elongate tubular body portion so as to minimize the inertial forces resulting from the weight of a water hose connected to the soil boring device.

16. The soil boring kit according to claim 8, wherein the end wall of the hollow body portion of the vacuum collar that contains the aperture is disposed at a top of the hollow body portion; and wherein the hollow body portion of the vacuum collar further comprises an open bottom disposed opposite to the top end wall, the open bottom of the vacuum collar configured to be disposed against the ground at the top of the hole in the ground.

17. The soil boring kit according to claim 8, wherein the vacuum hose connection member of the vacuum collar has a central axis that is disposed generally perpendicular to a centrally disposed axis of the hollow body portion of the vacuum collar.

18. The soil boring kit according to claim 8, further comprising a vacuum wand, the vacuum wand including:

a wand elongate tubular body portion that is configured to be inserted into the hole in the ground, the wand elongate tubular body portion comprising a vacuum inlet disposed at a first end of the wand elongate tubular body portion and a vacuum outlet disposed at a second end of the wand elongate tubular body portion that is opposite to the first end, the vacuum outlet of the wand elongate tubular body portion configured to be fluidly coupled to the vacuum source so as to create a suction force in the wand elongate tubular body portion, and the vacuum inlet of the wand elongate tubular body portion configured to extract the water and loosened soil from the hole in the ground as a result of the suction force created by the vacuum source.

19. The soil boring kit according to claim 18, wherein the vacuum collar and the vacuum wand are configured to be interchangeably connected to the vacuum source.

20. A soil boring device for forming a hole in the ground, comprising:

an elongate tubular body portion having a first end and a second end disposed opposite to the first end, the elongate tubular body portion defining a fluid passageway disposed therein, the elongate tubular body portion further defining a water outlet fluidly coupled to the fluid passageway for discharging water from the soil boring device, the elongate tubular body portion further comprising a peripheral sidewall defining the fluid passageway;

at least one fin member protruding radially outward from an outer surface of the peripheral sidewall of the elongate tubular body portion, the at least one fin member configured to loosen soil when the soil boring device is rotated about a centrally disposed longitudinal axis of the elongate tubular body portion by a user, the at least one fin member extending linearly from the outer surface of the peripheral sidewall of the elongate tubular body portion to a distal edge;

at least one handle portion extending outwardly from the elongate tubular body portion, the at least one handle portion configured to be grasped by the user while the user is rotating the soil boring device about the centrally disposed longitudinal axis; and a water connection subassembly coupled to the elongate tubular body portion, the water connection subassembly defining a water inlet for supplying water to the fluid passageway of the elongate tubular body portion;

wherein the soil boring device is configured to discharge water from the water outlet of the elongate tubular body portion so as to moisten soil adjacent to the soil boring device, thereby facilitating the forming of the hole in the ground by allowing the soil to be more easily loosened by the at least one fin member.

21. The soil boring device according to claim 20, wherein the water connection subassembly further comprises a U-shaped connection between the water valve and the first end of the elongate tubular body portion; and wherein a central axis of the hose connector is disposed generally parallel to, and closely spaced apart from, the centrally disposed longitudinal axis of the elongate tubular body portion so as to minimize the inertial forces resulting from the weight of a water hose connected to the soil boring device.

* * * * *